US006555950B1

(12) United States Patent
Hendriks et al.

(10) Patent No.: US 6,555,950 B1
(45) Date of Patent: Apr. 29, 2003

(54) COLOR DISPLAY TUBE WITH IMPROVED SUSPENSION OF THE COLOR SELECTION ELECTRODE

(75) Inventors: Arnoldus Antonius Maria Hendriks, Eindhoven (NL); Wilhelmus Marinus Maria Van De Steen, Eindhoven (NL); Jean Winters, Eindhoven (NL); Piet Christiaan Jozef Van Rens, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 320 days.

(21) Appl. No.: 09/722,814

(22) Filed: Nov. 27, 2000

(30) Foreign Application Priority Data

Nov. 26, 1999 (EP) ..... 99203977

(51) Int. Cl.[7] ..... H01J 29/80

(52) U.S. Cl. ..... 313/402; 313/404; 313/406; 313/407

(58) Field of Search ..... 313/402, 403, 313/404, 405, 406, 407

(56) References Cited

U.S. PATENT DOCUMENTS 5,003,218 A 3/1991 Gijrath et al. ..... 313/406
5,982,085 A * 11/1999 Lakshmanan et al. ..... 313/407
6,008,571 A * 12/1999 Van Oekel et al. ..... 313/402

* cited by examiner

*Primary Examiner*—Robert H. Kim
*Assistant Examiner*—Elizabeth Gemmell
(74) *Attorney, Agent, or Firm*—Aaron Waxler

(57) ABSTRACT

A color display tube (1) is disclosed with an improved suspension of the color selection electrode (12). In order to have a color display tube with good properties of, for instance, color purity, it is of eminent importance that the color selection electrode (12) has and excellent positional stability. Especially wide screen tubes seem to be more sensitive to external shocks by which the color selection electrode (12) may shift and cause discolorations. The positional stability of the color selection electrode (12) can be improved by decreasing the friction between the color selection electrode (12) and the supporting elements (17) in the display window (3) of the color display tube (1). This is achieved by applying a supporting element (17) with a free end portion (22) having a small diameter and by applying a low force between the suspension means (20) and the supporting elements (17). As a consequence of the light-weight construction of the color selection electrode (12), this force can be lowered to about 4 newtons.

5 Claims, 7 Drawing Sheets

COLOR DISPLAY TUBE WITH IMPROVED SUSPENSION OF THE COLOR SELECTION ELECTRODE

BACKGROUND OF THE INVENTION

The invention relates to a color display tube comprising a display window with a circumferential upright edge and corner areas, a color selection electrode comprising corner sections to which suspension means are coupled, which color selection electrode is suspended from supporting elements having free end portions, secured to the corner areas.

The invention also relates to a supporting element for use in a color display tube, a corner section for use in a color selection electrode of a color display tube, and a color selection electrode provided with such a corner section.

SUMMARY OF THE INVENTION

A color display tube as described in the opening paragraph is disclosed in U.S. Pat. No. 5,003,218. The color display tube according to this specification is provided with a color selection electrode having a frame consisting of four diaphragm parts and four corner sections, suspended in the corners of the display window.

The color display tube described in U.S. Pat. No. 5,003,218 is provided with a color selection electrode to make sure that electron beams coming from three electron guns, mounted in a neck portion of the tube, only excite one color of electroluminescent material on the inner side of the display window. This color selection is achieved by applying, for instance, a shadow mask in the tube. This mask has a large number of apertures, in most cases arranged in either a slotted or a dotted pattern. If the color selection electrode is not positioned in the color display tube in a stable manner, small deviations of its position will lead to a deterioration of the picture quality. When the color selection electrode is shifted slightly, the shadowing effect of the color selection electrode changes and, consequently, the electron beams do not hit the appropriate electroluminescent material on the display window. This misregistration causes a lack of the corresponding color, or even worse, the wrong color of electroluminescent material is excited. These misregistrations cause discoloration of the display tube that lead to a deterioration of the quality of the picture on the color display tube. In practice, color display tubes provided with the suspension system as described in U.S. Pat. No. 5,003,218 show discolorations that are too large to fulfil the ever-increasing demand for picture quality. Especially wide-screen tubes and tubes with a real flat or almost flat outer surface of the display window suffer from these problems. It is a disadvantage of the known color display tube that it shows too large misregistrations.

It is an object of the invention to provide a color display tube having a color selection electrode with an improved suspension system as compared with the type described in the opening paragraph, which strongly diminishes the registration errors on the display window.

According to the present invention, this object is realized with a color display tube which is characterized in that the free end portions have a diameter which is smaller than 5 mm for display windows having a width of more than 600 mm and smaller than 4 mm for display windows having a width of less than 600 mm.

The invention is based on the recognition that the registration errors are diminished when the friction between the suspension means and the supporting elements is decreased. This is realized when the diameter of the free end portions is reduced. The lower friction enhances the positional accuracy of the color selection electrode with respect to the display window.

During the manufacturing process, the color selection electrode has to be inserted into and extracted from the display window several times. First, the black matrix layer and then the three phosphors are applied by using a photosensitive process. For these four process steps, the color selection electrode has to be inserted and extracted. The insertion reproducibility is a major factor in the positional accuracy of the color selection electrode. The color selection electrode will take up about the same position when it is inserted again if the friction is low, thereby improving the insertion reproducibility.

A second source of misregistration is shifts of the color selection electrode that may occur in the color display tube after it has been manufactured. These shifts are caused by heavy shocks to which the color display tube is exposed, for instance during transportation. For this situation as well, a lower friction between the suspension means and the supporting elements leads to a larger positional stability of the color selection electrode. Because of the lower friction, the color selection electrode returns more easily to the original position after a shock has occurred.

In larger tubes, especially wide-screen tubes with a slotted mask, the misregistrations are mainly caused by shifts of the color selection electrode in the east/west—normally the horizontal—direction. This causes the width of the tube to be the dominant factor for determining the diameter of the free end portion of the supporting means. Due to the weight of the tube and the associated color selection electrode for larger tubes—i.e. display windows width of more than 600 mm—a larger diameter of the free end portion is preferred.

The free end portions normally used in color display tubes are in general rotationally symmetric around some given axis. This makes it possible to define a diameter for free end portions, namely, the diameter of the smallest cylinder which contains the free end portion and whose axis coincides with the axis of the supporting element. This definition is not limited to a free end portion which is spherically curved; amongst others, also cylindrical, conical and other rotationally-symmetric shapes are included.

A preferred embodiment of the color display tube according to the present invention is characterized in that the diameter of the free end portion is smaller than 4 mm for display windows having a width of more than 600 mm and smaller than 3 mm for display windows having a width of less than 600 mm. A further decrease of the diameter of the free end portions further lowers the friction between the supporting elements and the suspension means. This preferred embodiment yields an excellent compromise between the friction and the mechanical strength of such a free end portion.

A further embodiment is characterized in that the free end portions are substantially spherically curved. From a manufacturing point of view, a supporting element with a free end portion which is spherically curved is relatively easy to produce. For instance, if an assembled—two-part—supporting element is used, the free end portions may be obtained by making use of a highly accurate standard ball.

A still further embodiment is characterized in that the suspension means comprise a resilient element which exerts a force of less than 6 newtons on the free end portions. Forces smaller than 4 newtons are preferred.

This measure also decreases the friction between the suspension means and the free end portions of the supporting elements. A color display tube with a color selection electrode comprising a frame with corner sections and diaphragm parts allows the construction of a lightweight frame. This makes it possible to use low forces between the resilient elements of the suspension means and the free end portions of the supporting elements, thereby decreasing the friction. In the situation where the forces between the suspension means and the supporting elements are less than 6 newtons, the misregistrations become so small that a picture with a good color purity can be reproduced on the color display tube. Misregistrations caused by friction between the suspension means and the supporting elements can even be ignored if the forces are less than 4 newtons.

The invention also relates to the supporting elements for use in such a color display tube, the corner section of a color selection electrode, and a color selection electrode provided with such a corner section.

These and other aspects of the invention are apparent from and will be elucidated by way of non-limitative examples with reference to the drawings and the embodiments described hereinafter.

DESCRIPTION OF THE PREFERRED EMBODIMENTS

Figure 1:
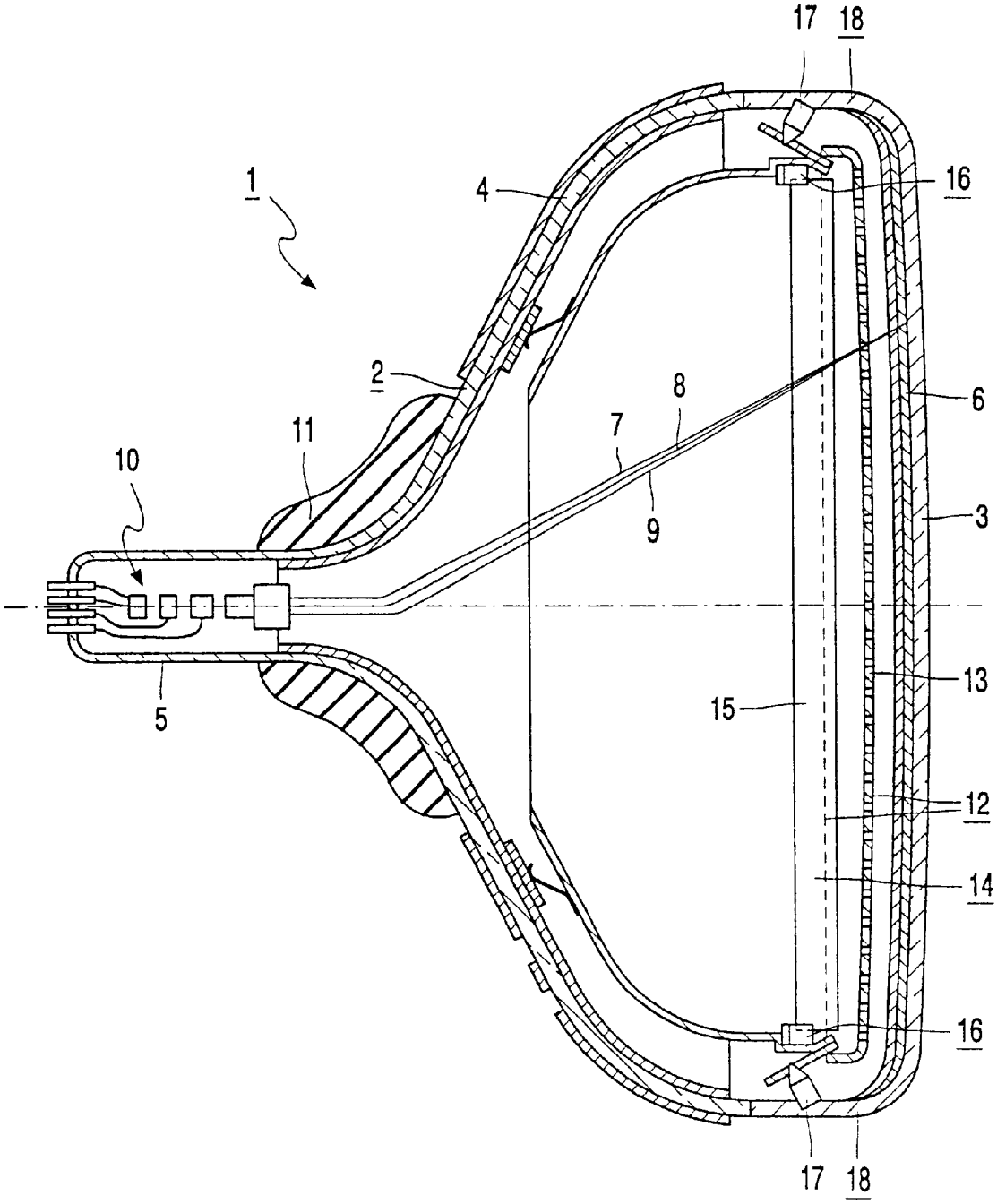
FIG. 1 is a sectional view of a color display tube according to the invention.

The color display tube 1 shown in FIG. 1 comprises an evacuated glass envelope 2 with a display window 3, a funnel-shaped part 4 and a neck 5. A screen 6 having a pattern of, for example, lines or dots of phosphors luminescing in different colors (e.g. red, green and blue) may be arranged on the inner side of the display window 3. The phosphor pattern is excited by the three electron beams 7, 8 and 9 generated by the electron gun 10. On their way to the screen, the electron beams 7, 8 and 9 are deflected by the deflection unit 11 ensuring that the electron beams 7, 8 and 9 systematically scan the screen 6. Before the electrons hit the screen 6,they pass through a color selection electrode 12. This color selection electrode 12 comprises a shadow mask 13, which is the real color-selective part: it intersects the electron beams so that the electrons only hit the phosphor of the appropriate color. The mask 13 may be an apertured mask having circular or elongate apertures, or a wire mask. Furthermore, the color selection electrode 12 comprises the frame 14 for supporting the mask. Parts which can be distinguished in the frame 14 are, amongst others, the corner sections 16 and the diaphragm parts 15, interconnecting the corner sections 16.

The color selection electrode 12 is suspended from the display window 3 by using supporting elements 16, which are secured in the upright edge of the corner areas 18 of the display window 3. This way of suspending the color selection electrode 12 in a color display tube 1 will be further referred to as corner suspension.

Figure 2:
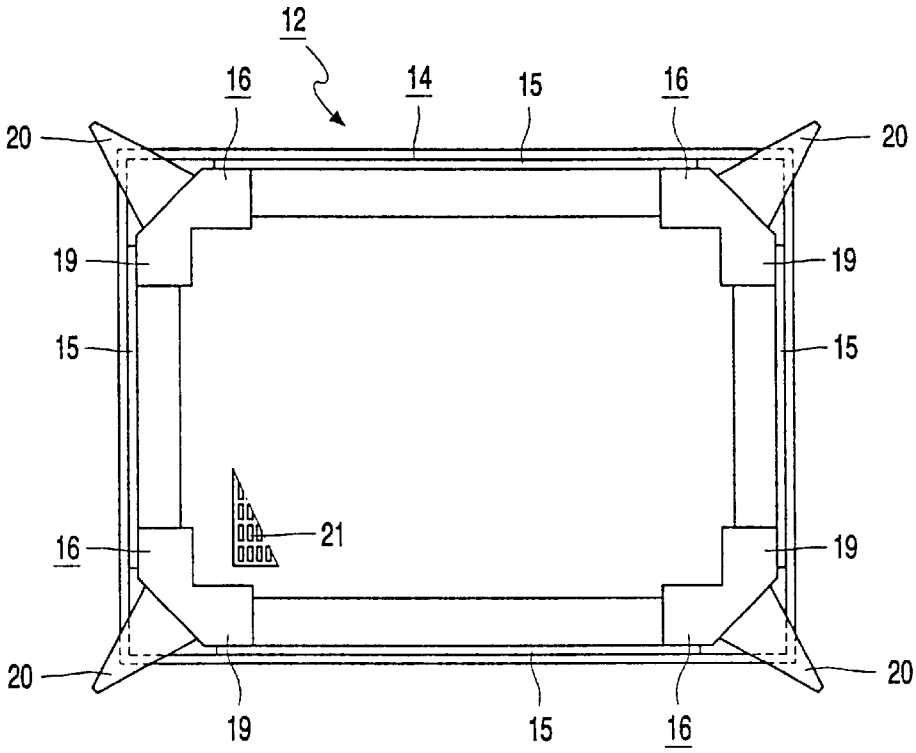
FIG. 2 is an elevational view of a color selection electrode to be mounted in the tube of FIG. 1.

FIG. 2 is an elevational view of a color selection electrode 12. The corner sections 16 in this Figure comprise two major portions, a rigid portion 19 for coupling the diaphragm parts 15 and a suspension element 20 for suspending the color selection electrode 12 from the display window 3. The mask 13 may be fixed to the diaphragm parts 15. The section 21 of the mask as indicated in FIG. 2 is only meant as an example. During the manufacturing process, the color selection electrode 12 has to be inserted into and extracted from the display window 3 several times, amongst others for the processes of depositing the matrix and phosphor layers. In order to fulfil the demands regarding the required accuracy of the matrix and phosphor patterns, it is necessary that the position of the color selection electrode 12 can be reproduced very accurately when it is inserted again. This requires a high positional stability of the color selection electrode 12 in the color display tube 1.

Another aspect in current color display tubes, which is becoming increasingly important, is the positional stability of the color selection electrode 12 due to transportation or other shocks, especially in the east/west direction. The term east/west is commonly used for the direction in the plane of the three electron beams 7, 8 and 9. Normally, this is the horizontal direction. In particular, wide-screen color display tubes having an aspect ratio of more than 4:3, preferably 16:9, suffer from a great sensitivity to these shocks. Displacements of up to a 100 $\mu$m of the color selection electrode 12 may occur, which will cause severe problems with the color purity of the tube 1. This displacement effect is often referred to as 'swing effect'.

Figure 3:
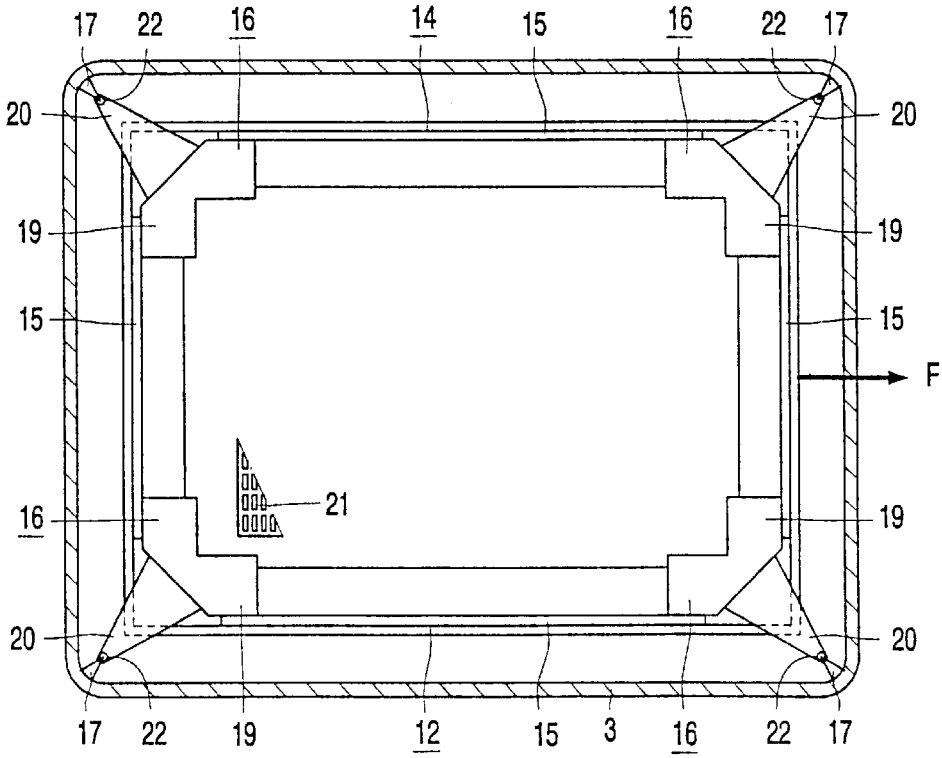
FIG. 3 is an elevational view of a color selection electrode mounted in a display window indicating the displacement measurement.
Figure 4:
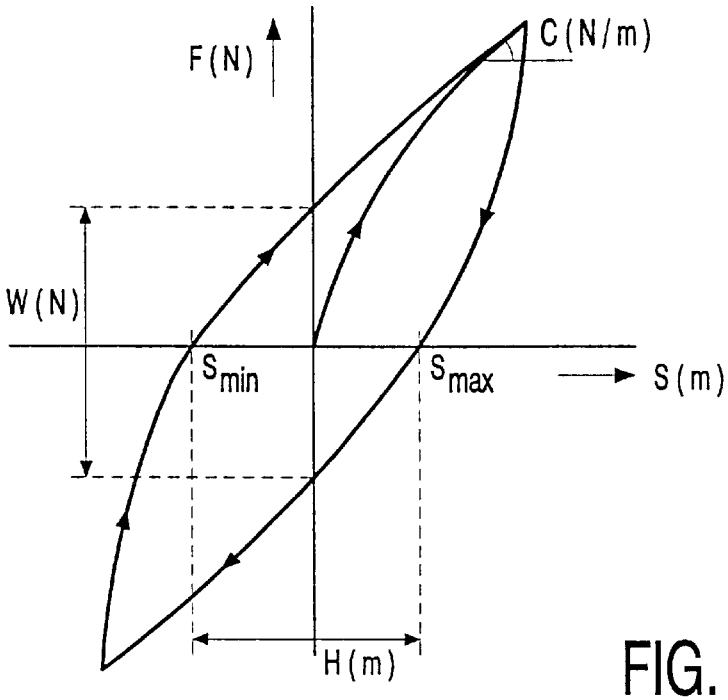
FIG. 4 is a graph indicating the hysteresis behavior of the color selection electrode.

This swing effect of the color selection electrode 12 can be explained in terms of a hysteresis diagram which can be constructed by a measurement as schematically shown in FIG. 3. The color selection electrode 12 is placed in a display window 3 and suspended from the supporting elements 17. Starting from a neutral situation, a force F is applied in the east/west direction on the color selection electrode 12. For a range of forces applied—from zero to a certain maximum, then back to zero, to a certain minimum and back to zero—the resulting displacement S of the color selection electrode is measured. The results of this measurement are shown in FIG. 4. This Figure demonstrates that a certain displacement remains when the force has been reduced back to zero. This is the so-called hysteresis effect. The consequence of this hysteresis is that, if a tube has been exposed to some external force—and this force is reduced to zero—a displacement of the color selection electrode 12 which may be in the total range between $S_{min}$ and $S_{max}$ may remain afterwards. This total range is now called the total hysteresis H (in m), being the total positional inaccuracy of the color selection electrode 12. Within this range, the system has no sufficient internal force to bring the color selection electrode 12 back to its neutral position. This total hysteresis H depends on two factors, namely the friction W of the suspension element 20 on the supporting element 17 and the stiffness C of the color selection electrode 12. The friction W (in N) is defined as the force range if the displacement is zero; the stiffness C (in N/m) is the inclination of the hysteresis curve for large forces (see FIG. 3). The relation between the hysteresis H, the friction F and the stiffness C can be approximated by:

$$H \approx \frac{W}{C}$$

This formula easily shows that the positional accuracy of the color selection electrode can be improved—that is to say, the hysteresis should be made smaller—by increasing the stiffness or by decreasing the friction of the system.

In this disclosure, the measures to decrease the friction between the suspension elements (20) and the supporting elements (17) of the color selection electrode (12) are discussed for a color selection electrode (12) whose stiffness has already been optimized.

Figure 5:
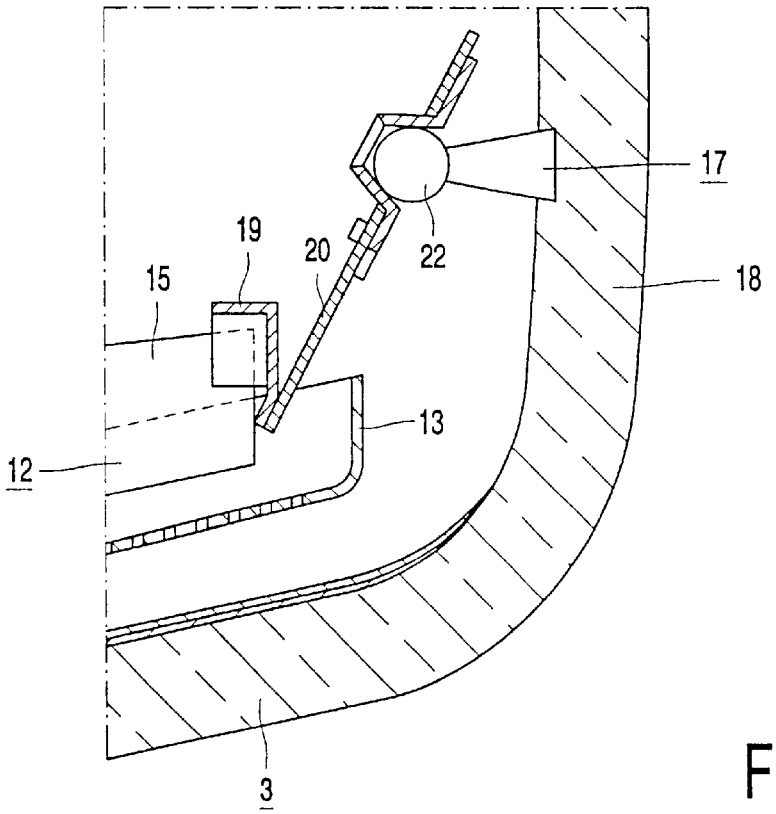
FIG. 5 is a sectional view of a portion of a tube like that of FIG. 1 showing the prior art suspension of a color selection electrode.
Figure 6:
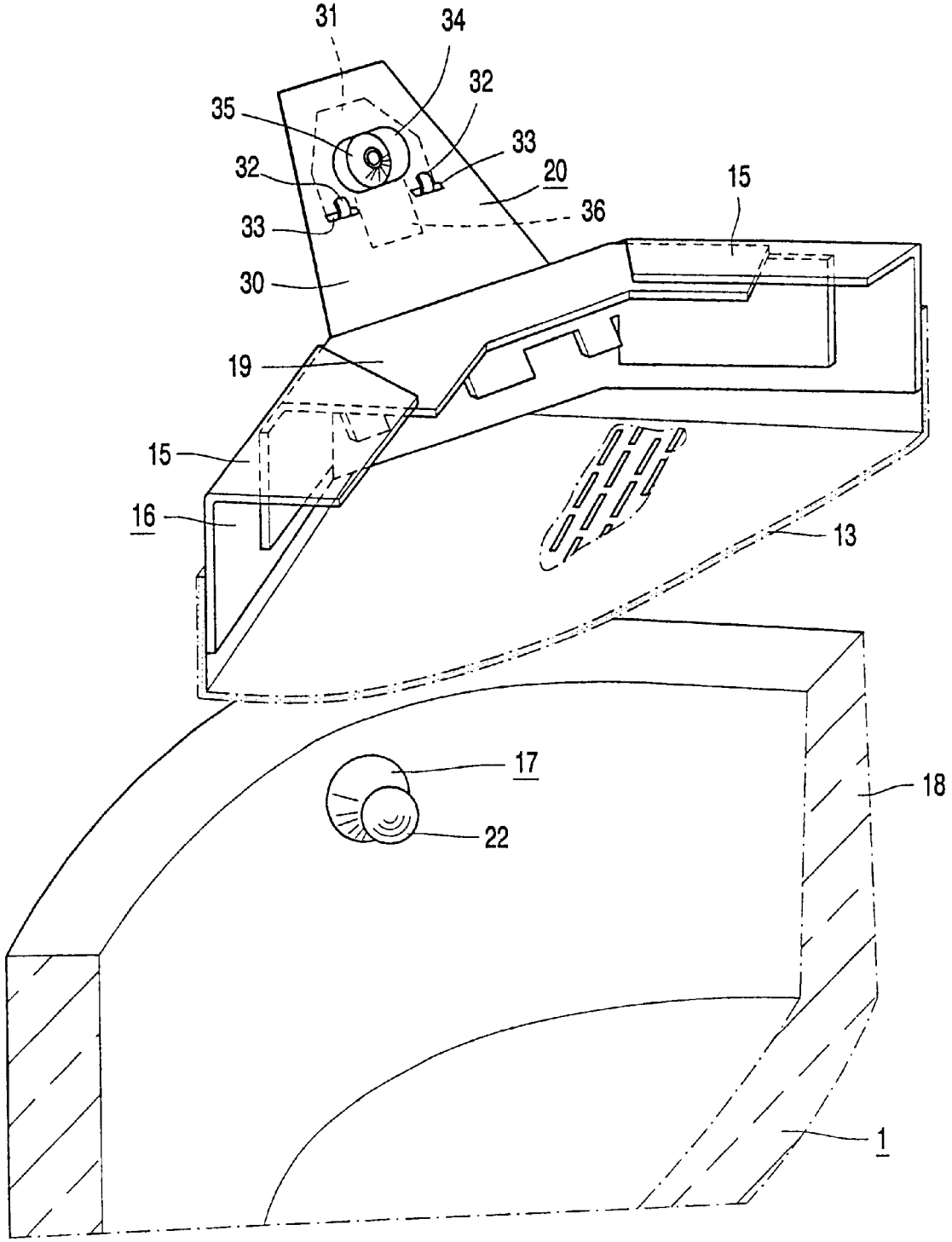
FIG. 6 is a perspective view of the corner area of the display window and the corner section of the color selection electrode.

FIGS. 5 and 6 show—in sectional and perspective view, respectively—the corner section 16 of the color selection electrode 12 according to the prior art, as well as the supporting element 22 in the display window 3. The corner section 16 comprises a rigid portion 19 to which the diaphragm parts 15 and a suspension element 20 are connected. This suspension element 20 comprises, among others, the following parts. The resilient element 30 is connected to the rigid portion 19 and has a slotted aperture 34. Mounted behind this slotted aperture 34 is a slide plate 31, for instance, by means of two bent tags 32 which protrude through apertures 33 in the resilient element 30. This slide plate 31 comprises a conical section 35 for engaging the more or less spherical free end portion 22 of the supporting element 17. After the color selection electrode 12 has been inserted into the display window for the first time, the slide plate 31 is rigidly secured to the resilient element 30, which may be done by welding the supporting member 36 to the resilient element 14.

Figure 7:
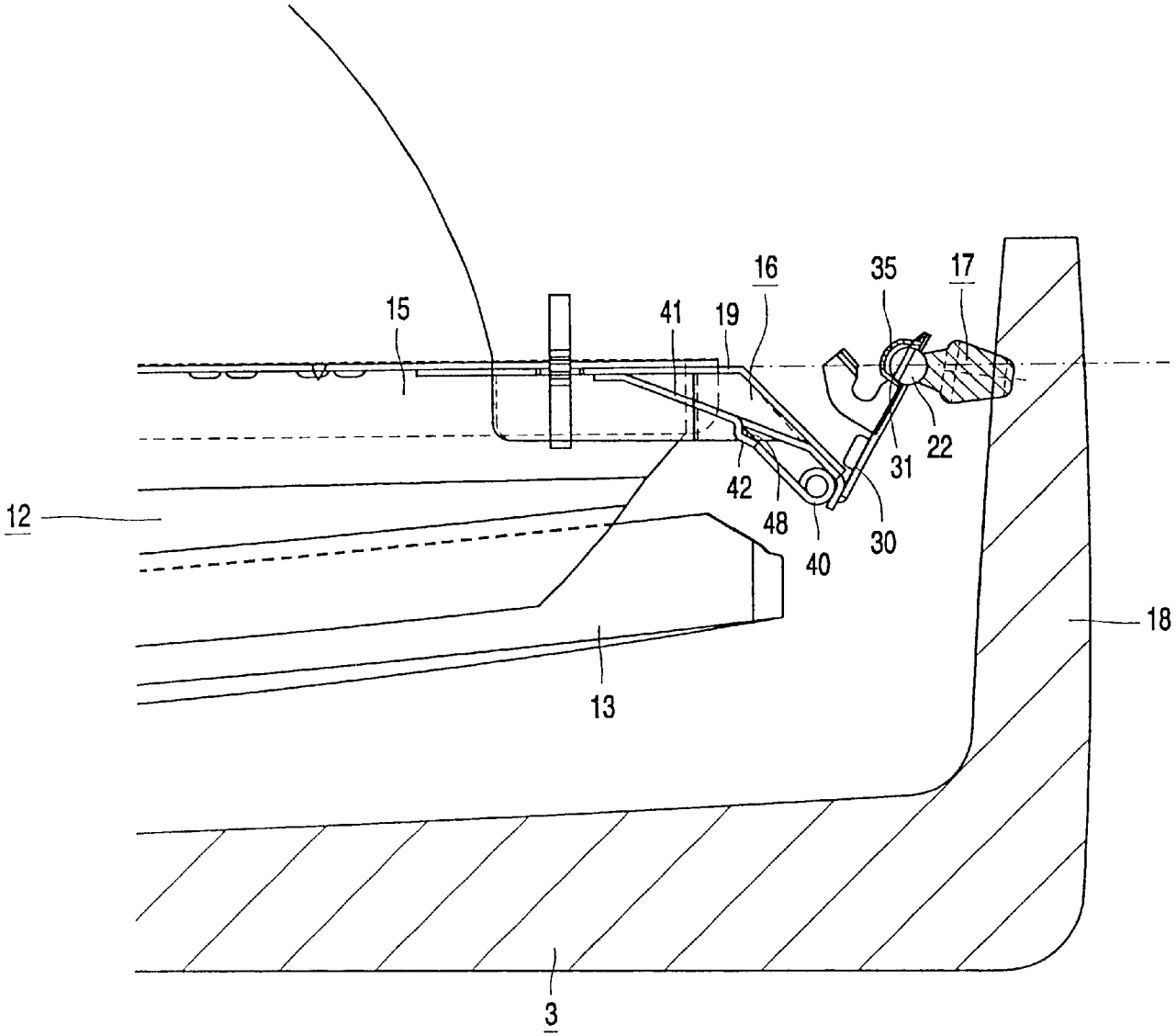
FIG. 7 is a cross section of a portion of a tube of FIG. 1 showing the corner section of the color selection electrode according to the invention.

FIG. 7 shows the preferred embodiment of the invention. This Figure is a cross-section of a part of the color selection electrode 12 with the corner section 16 connected to the supporting element 17 having a free end portion with a reduced diameter. In order to diminish the friction between the free end portion 22 of the supporting element 17 and the suspension element 20, and more particularly the conical section 35 thereof, the diameter of the free end portion 22 has to be decreased with respect to the diameter currently used.

The positional stability of the color selection electrode 12 mainly depends on the width of the display window 3. This width should be used as a parameter which determines the diameter of the free end portions 22. As can be seen, a diameter of 6.0 mm is used for prior art tubes having a width of more than 600 mm, while the diameter is 4.8 mm for tubes having a width of less than 600 mm. In order to have a significant decrease of the friction, these diameters should be decreased by at least 15%, leading to a diameter which is smaller than 5 mm for tubes having a width of more than 600 mm, and 4 mm for tubes having a width of less than 600 mm.

As an example, a diameter of 4.78 mm is probably preferred for the 28"/16:9 and 32"/16:9 wide-screen tubes. This has the advantage that for the free end portions 22 balls can be used that belong to a standard product range and can be obtained with a high accuracy. In this case, a two-part supporting element 17 is used: the free end portion 22 is connected to the lower part of the supporting element 17. Of course, a one-part supporting element 17 may be used alternatively.

The friction between the free end portion 22 and the conical section 35 also depends on the accuracy of the parts used. If, for instance, the free end portion 22 is on the large side and the conical section 35 is on the small side, the friction will be high. For a proper friction value, it is therefore of great importance that both the free end portion 22 and the conical section 35 are as accurate as possible.

Figure 8:
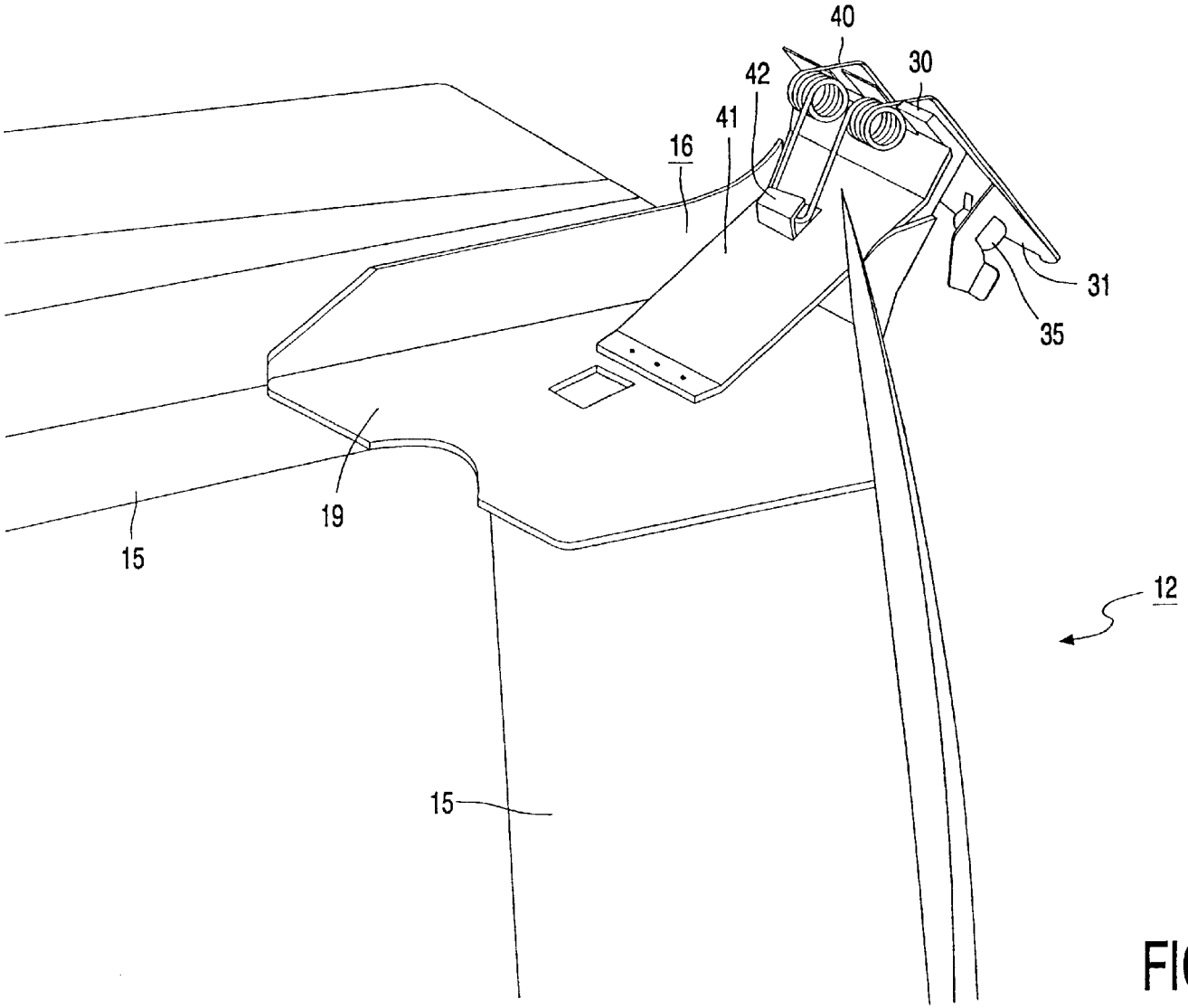
FIG. 8 is a perspective view of the corner section and the adjacent diaphragm parts of the color selection electrode according to the invention.
Figure 9:
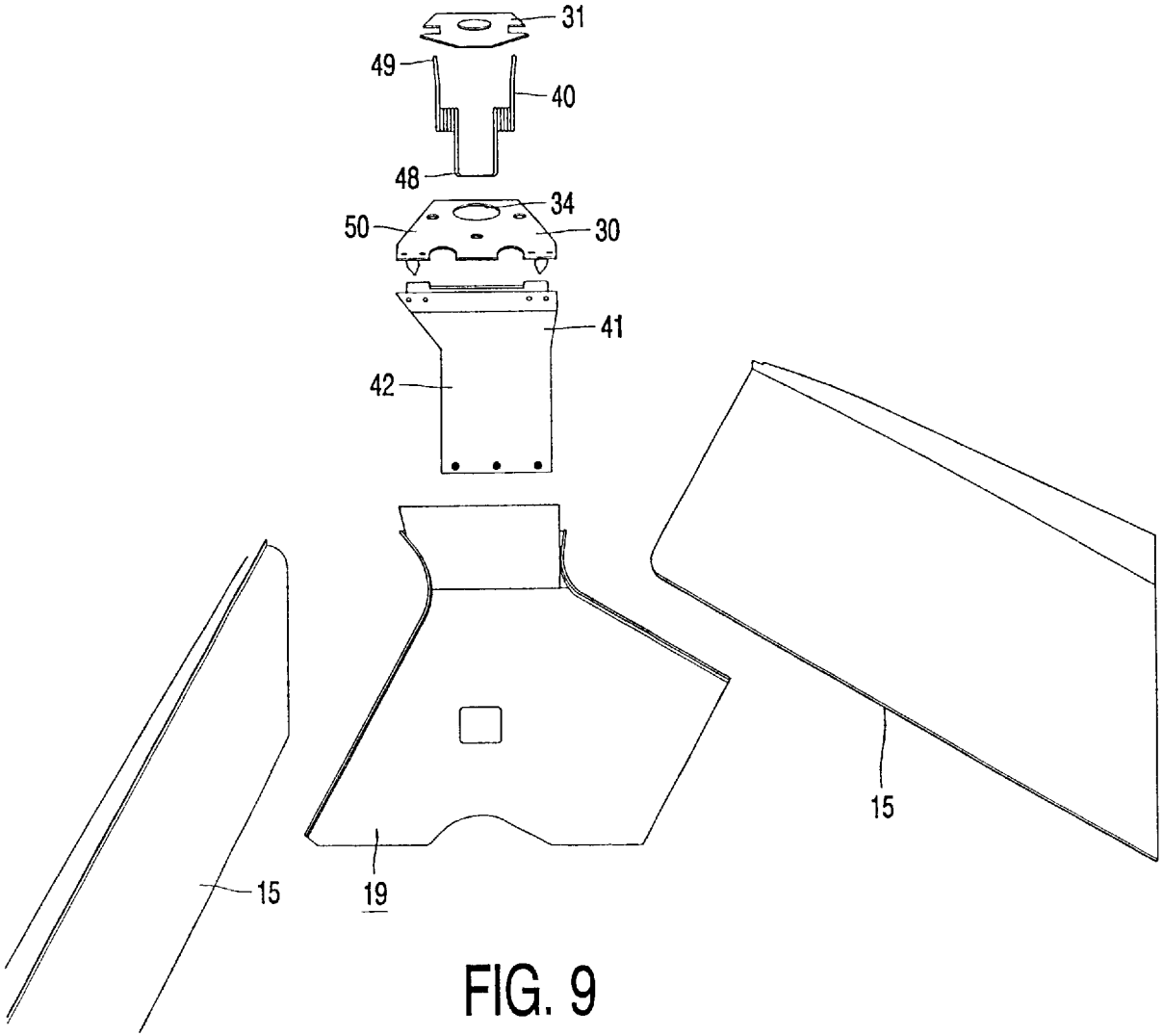
FIG. 9 is an exploded and a perspective view of the corner section and the adjacent diaphragm parts of the color selection electrode according to the invention.

FIGS. 8 and 9 are a perspective and an exploded view, respectively, of the corner section 16 of the color selection electrode 12 according to invention. These Figures also show the slide plate 31 which comprises the conical section 35. The presence of such a slide plate 31, which is firmly connected to the resilient element 30 after the first time the color selection electrode 12 has been inserted, also diminishes the friction. Due to tolerances in the manufacturing process, there may be some inaccuracy between the four conical sections 35 and the four free end portions 22. These inaccuracies normally lead to unwanted stresses between the conical sections 35 and the free end portions 22. The slide plates 31 prevent this by compensating for these manufacturing tolerances.

In color display tubes with a corner suspension system, the frame 14 of the color selection electrode 12 may have a lightweight construction. Such a frame 14 comprises four diaphragm parts 15 and four corner sections 16. As an example, the diaphragm parts can be made from steel or invar material with a thickness of 0.2 mm, enabling a construction in which the frame 14 weighs not more than 300 grams. The strength of the color selection electrode 12 is then largely given by the fact that it is suspended in the corner areas 18 of the display window 3. The lightweight frame construction makes it possible to use a very low force between the conical sections 35 of the suspension means 20 and the free end portions 22 of the supporting elements 17. This force should be large enough to hold the mass of the color selection electrode 12 in place, so a lower mass means a lower force. Experiments have shown that it is possible to lower the force to as far as 4 newtons, and even lower values should be possible.

This force is determined by the construction of the suspension means 20. In FIG. 7, the resilient element 30 has been provided with a wire-wound spring 40 in order to make sure that the color selection electrode 12 is mounted in the display window 3 with a force which guarantees a reliable connection between the color selection electrode 12 and the supporting elements 17. One end of the spring 48 is held in place by a lug 42 which has been cut in the additional support plate 41, the other end 49 protrudes through apertures 50 in the resilient element 30 to simultaneously hold the shift plate 31. This is best seen in the exploded view of FIG. 9. The force between the conical section 35 and the free end portion 22 is determined by the strength of the wire-wound spring 40.

This lightweight frame 14 and the resultant low force are major advantages of a color display tube with a corner suspension as compared with tubes with an axial suspension which needs a much heavier frame.

As an example, incorporation of the options for manufacturing a color display tube with improved behavior on positional stability of the color selection electrode 12 renders the results given in Table 1. In this Table, measurements on an existing 32" wide-screen tube with a super flat display window, are compared with a 32" wide-screen tube with improved hysteresis and a real flat display window.

TABLE 1

| | | 32" Wide Screen Super Flat PRIOR ART | 32" Wide Screen Real Flat INVENTION |
|---|---|---|---|
| Hysteresis | H (μm) | 95 | 9 |
| Friction | W (N) | 7.5 | 2.5 |
| Stiffness | C (N/mm) | 66 | 208 |

This Table shows that the measures described in this document will decrease the friction between the suspension means and the supporting elements by a factor of 3. If also the improvement in stiffness is taken into account, the hysteresis is improved by a factor of 10. Note that the hysteresis figures mentioned in this Table are in fact the real shift of a color selection electrode that may occur in the normal production process.

It will be clear to a person skilled in the art that this invention is not limited to the examples given here. Alternative measures for decreasing the friction between the suspension means and the supporting elements in a color display tube 1 will reach the same objective.

In summary, a color display tube 1 is disclosed with an improved suspension of the color selection electrode 12. In order to have a color display tube with good properties of, for instance, color purity, it is of eminent importance that the color selection electrode 12 has an excellent positional stability. Especially wide-screen tubes seem to be more sensitive to external shocks by which the color selection electrode 12 may shift and cause discolorations. The positional stability of the color selection electrode 12 can be improved by decreasing the friction between the color selection electrode 12 and the supporting elements 17 in the display window 3 of the color display tube 1. This is achieved by applying a supporting element 17 with a free end portion 22 having a small diameter and by applying a low force between the suspension means 20 and the supporting elements 17. As a consequence of the lightweight construction of the color selection electrode 12, this force can be lowered to about 4 newtons.

What is claimed is:

1. A color display tube (1) comprising a display window (3) with a circumferential upright edge and corner areas (18), a color selection electrode (12) comprising corner sections (16) to which suspension means (20) are coupled, which color selection electrode (12) is suspended from supporting elements (17) having free end portions (22), secured to the corner areas (18), characterized in that the free end portions (22) have a diameter which is smaller than 5 mm for display windows having a width of more than 600 mm and smaller than 4 mm for display windows having a width of less than 600 mm.

2. A color display tube (1) as claimed in claim 1, characterized in that the diameter of the free end portion (22) is smaller than 4 mm for display windows having a width of more than 600 mm and smaller than 3 mm for display windows having a width of less than 600 mm.

3. A color display tube (1) as claimed in claim 1, characterized in that the free end portions (22) are substantially spherically curved.

4. A color display tube (1) as claimed in claim 1, characterized in that the suspension means (20) comprise a resilient element (30) which exerts a force of less than 6 newtons on the free end portions (22).

5. A color display tube (1) as claimed in claim 4, characterized in that the force exerted by the resilient element (30) on the free end portions (22) is smaller than 4 newtons.

* * * * *